United States Patent [19]

Bald

[11] 4,266,652

[45] May 12, 1981

[54] APPARATUS FOR CONVEYING ARTICLES

[75] Inventor: Hubert Bald, Gevelsberg, Fed. Rep. of Germany

[73] Assignee: Maschinenfabrik Alfred Schmermund GmbH & Co., Gevelsberg, Fed. Rep. of Germany

[21] Appl. No.: 92,879

[22] Filed: Nov. 9, 1979

[30] Foreign Application Priority Data

Nov. 10, 1978 [DE] Fed. Rep. of Germany ..... 2848773

[51] Int. Cl.[3] ..... B65G 1/04

[52] U.S. Cl. ..... 198/347; 198/575; 198/577

[58] Field of Search ..... 198/347, 460, 461, 462, 198/594, 575, 577

[56] References Cited

FOREIGN PATENT DOCUMENTS 1298427 6/1967 Fed. Rep. of Germany ..... 198/347

2618905 11/1977 Fed. Rep. of Germany ..... 198/347

*Primary Examiner*—James L. Rowland

*Attorney, Agent, or Firm*—Sughrue, Rothwell, Mion, Zinn and Macpeak

[57] ABSTRACT

An apparatus for conveying articles such as cigarettes transversely to the axis thereof and for temporarily storing the articles between a machine for continuously feeding the articles to the apparatus and a removal device for periodically removing said articles from the apparatus. The apparatus includes a feeder to receive an accumulation of articles coming from the machine, a transfer conveyor to receive articles from the accumulation, a grooved belt to receive articles from the transfer conveyor, a common regulable drive to drive the transfer conveyor and the grooved belt and a gear disposed between the common drive and the grooved belt and operable to have a periodically changing gear ratio to oscillate the transfer conveyor along the grooved belt and to provide the grooved belt with a varying conveying speed. At a given instant the oscillation of the transfer conveyor has a speed equal to any difference between the speed of the grooved belt and the speed of the transfer conveyor.

5 Claims, 1 Drawing Figure

APPARATUS FOR CONVEYING ARTICLES

BACKGROUND OF THE INVENTION

The present invention relates to an apparatus for conveying articles such as cigarettes transversely to the axis thereof and for temporarily storing the articles between a machine for continuously feeding the articles to the apparatus and a removal device for periodically removing the articles from the apparatus.

Such an apparatus may be arranged between a cigarette strand machine or filter-attaching machine and a threstle filler and in that case serves two tasks in which the cigarette strand machine or other upstream machine delivers the cigarettes in a continuous stream in which the cigarettes are irregularly spaced due to damaged cigarettes being, for example, separated out. The removal device must, however, always be presented with complete sets of a predetermined number of cigarettes substantially at standstill. The interposed apparatus therefore forms an accumulation of the cigarettes delivered by the upstream machine, from which stream the cigarettes are then withdrawn batchwise. Secondly, the upstream machine and the removal device are driven from separate drives and therefore not synchronized in advance. For that reason, the drive of the removal device is re-regulated in dependence on the length of the accumulation.

DE-AS No. 12 98 427 discloses an apparatus in which a grooved belt is at one place constantly driven with a regulated rotational speed, but periodically stopped at the removal location. For this purpose, a loop of the grooved belt arrangement is formed, which under the control of a cam disc is pivotable together with a transfer conveyor around the axis of a smooth drum, on the peripheral surface of which an accumulation path is provided. At the downstream end of the accumulation, the cigarettes are subjected to an appreciable pressure which leads to disturbances in the removal. Furthermore, control by the cam disc is not entirely precise so that additional compensating devices must be provided.

DE-OS No. 26 18 905 discloses an apparatus, in which the cigarettes are accumulated on a horizontal path, whereby the cigarettes are preserved. The cigarettes are accumulated on a smooth conveyor belt and then transferred to a belt provided with grooves. The cigarettes taken over from the accumulation by this constantly running grooved belt are then conveyed around a deflection roller thereof to the run below the roller. Between this and the upper run of a grooved belt an intermediate conveyor in the shape of a grooved wheel is rotatably and displaceably arranged and which is driven into a superimposed circulatory and translatory motion in such a manner that the path speed of the cigarettes at the transfer location is equal to that of the removal belt. The drums of the grooved belts form storage means.

The plurality of the conveying means is disadvantageous since there is a danger of faults and damages occurring on each transfer of the cigarettes, the necessary overhead transport of the cigarettes additionally requiring expensive retaining means. It has proved to be advantageous in this apparatus to take the cigarettes over from the accumulation at constant speed.

It is an object of the present invention to provide an apparatus which with a simple construction, without overhead transport action of the cigarettes and with a cigarette take-over from a horizontal accumulation path operates reliably at constant speed.

SUMMARY OF THE INVENTION

According to the present invention there is provided an apparatus for conveying articles and for temporarily storing said articles between a machine for continuously feeding said articles to said apparatus and a removal device for periodically removing said articles from said apparatus, said apparatus comprising feeder means to receive and accumulate articles coming from said machine, transfer conveyor means to receive accumulated articles from said feeder means, grooved belt means to receive articles from said transfer conveyor means, common regulable drive means to rotate said transfer conveyor means and to drive said grooved belt means, and gear means disposed between said common drive means and said grooved belt means and operable to have a periodically changing gear ratio to oscillate said transfer conveyor means along said grooved belt means and to drive said grooved belt means at a varying conveying speed, whereby in operation—at a given instant—said oscillation of said transfer conveyor means has a speed equal to any difference between said speed of said groove belt means and the peripheral speed of said transfer conveyor means.

Although the apparatus is intended for use mainly with cigarettes, it can, however, be employed equally well with, for example, sleeves, cigarillos entire packets, or with rod-shaped articles, which is advantageous particularly when such articles are pressure-sensitive.

BRIEF DESCRIPTION OF THE DRAWING

An embodiment of the present invention will now be more particularly described by way of example and with reference to the accompanying drawing, the single FIGURE of which shows an apparatus embodying the present invention.

DESCRIPTION OF THE PREFERRED EMBODIMENT

Figure 1:
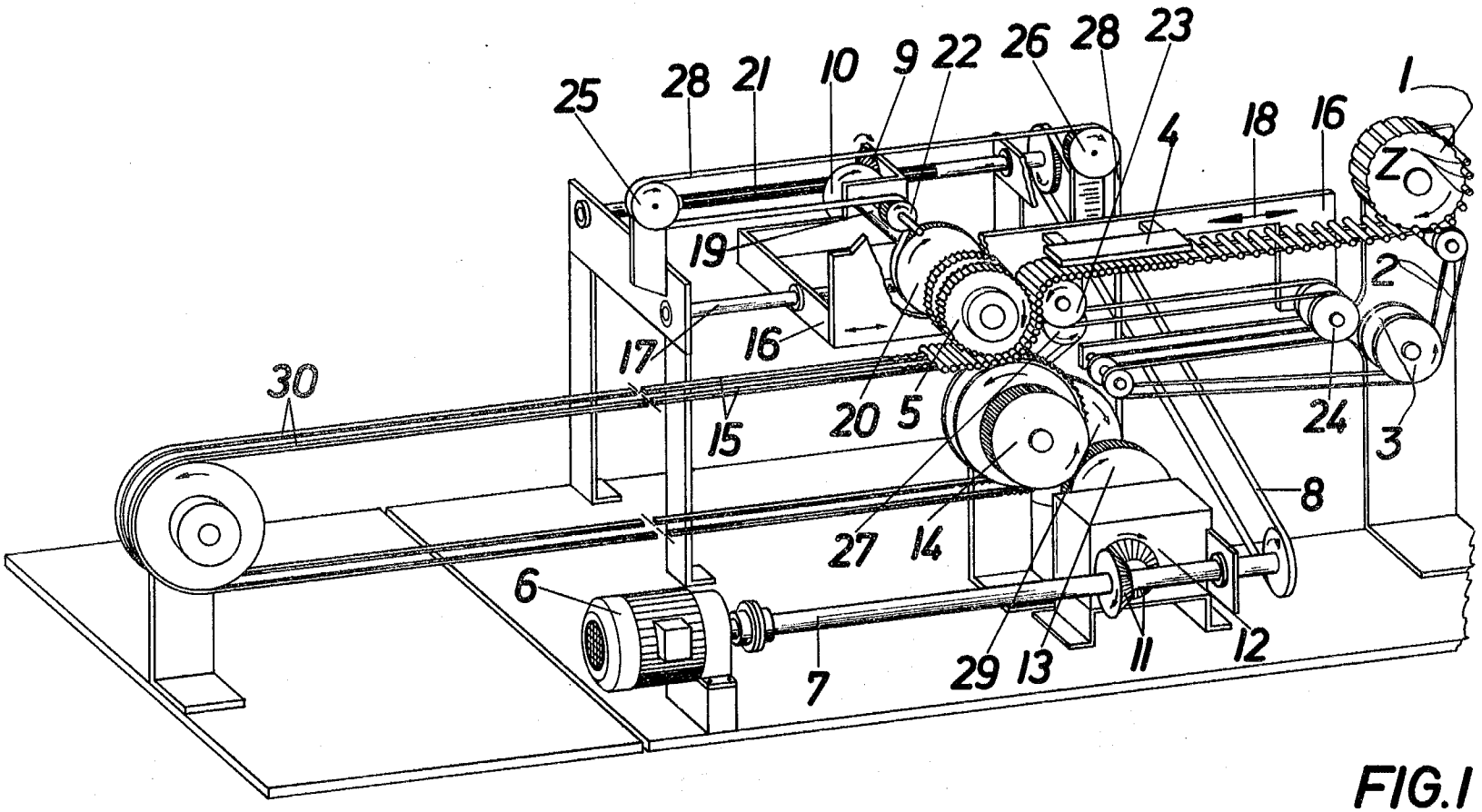

Cigarettes Z coming from an upstream machine (strand machine or filter-attaching machine) run over a grooved drum 1 into the apparatus. The grooved drum 1 is driven by the upstream machine at a constant rotational speed. The grooved drum 1 may be a component of the upstream machine. From the grooved drum 1, cigarettes are transferred to the smooth conveyor belts 2 which are driven at constant rotational speed through the rollers 3 likewise from the upstream machine, and accumulate under a measuring device 4 which picks up the instantaneous length of the accumulation.

From the accumulation, the cigarettes are conveyed by the grooved wheel 5 which is driven at constant rotational speed, i.e. constant apart from the rotational speed regulation which takes place in dependence on the length of the accumulation determined by the measuring device, from a drive motor 6 through a main shaft 7, a toothed belt 8 and bevel wheels 9 and 10.

The rotational movement of the main shaft 7 is transmitted through a bevel wheel pair 11 into a gear 12. This gear 12 converts the constant rotational speed of the main shaft into a rotational movement, the rotational speed of which fluctuates periodically, preferably between twice the introduced rotational speed and the instantaneous standstill, wherein the mean output rotational speed is equal to the input rotational speed.

This intermittent motion is transmitted through spur wheels 13 and 14 to grooved belts 15, which take the cigarettes over from the grooved wheel 5. Since the speed of the cigarettes disposed on the grooved wheel must at the transfer location be equal to the speed of the grooved belts 15, the rotary motion of the grooved wheel 5 has superimposed on it a translatory motion which compensates for the instantaneous speed difference. This motion is realized in the following manner:

Fastened to a carriage 16, which is displaceable on the guide 17 in direction of the double arrow 18 comprises the grooved wheel 5, a toothed belt wheel 20 and a bevel wheel 10 on a common shaft 19, the bevel wheel 9 which is displaceable on a splined shaft 21, a deflecting roller 22 and deflecting rollers 23 and 24 of the smooth belts 2. A toothed belt 28 which through roller 29 is acted upon by the intermittent speed of the gear 12, runs over the rollers 20 and 22 fastened to the carriage 16 as well as locally fixed rollers 25, 26 and 27.

The position of the carriage is shown in the instant, at which the increasing speed of the grooved belts 15 is equal to the speed of the cigarettes on the grooved wheel 5. When the speed of the grooved belts further increases, the carriage 16 is drawn to the left by the difference between the likewise increasing speed of the toothed belt 28 and the constant peripheral speed of the toothed belt wheel 20 connected with the grooved wheel 5 and until the decreasing speed of the grooved belts 15 is equal to the speed of the cigarettes on the grooved wheel 5. Then, with further decreasing speed of the groove belts 15 up to the instantaneous standstill and during subsequent acceleration to the grooved wheel speed, the carriage runs further to the right into the illustrated position and the cycle starts again. At the instant of standstill of the grooved belts 15, the cigarettes disposed in the position designated by 30 are raised off by known means (not shown) and for example transferred into a trestle.

The temporary intermediate storing of the cigarettes is thus realized on the groove belt 15 as the displacement path of the grooved wheel 5 as well as to a lesser extent in the accumulation below the measuring device 4.

Contrary to the known arrangement according to the DE-AS No. 12 98 427, the grooved belt has the same speed at every point and only the transfer conveyor and the accumulation path carry out the compensating motion. Since the drive of the compensating motion just as the circulatory drive of the grooved belt arrangement and also the circulatory drive of the transfer conveyor are derived from one and the same motor regulated in speed according to the length of the accumulation, the necessity of auxiliary equipments for compensation of irregularities is obviated.

I claim:

1. An apparatus for conveying articles and for temporarily storing said articles between a machine for continuously feeding said articles to said apparatus and a removal device for periodically removing said articles from said apparatus, said apparatus comprising:

(a) feeder means to receive and accumulate articles coming from said machine, (b) transfer conveyor means to receive accumulated articles from said feeder means, (c) grooved belt means to receive articles from said transfer conveyor means, (d) common regulable drive means to rotate said transfer conveyor means and to drive said grooved belt means, and (e) gear means disposed between said common drive means and said grooved belt means and operable to have a periodically changing gear ratio to oscillate said transfer conveyor means along said grooved belt means and to drive said grooved belt means at a varying conveying speed, whereby in operation—at a given instant—said oscillation of said transfer conveyor means has a speed equal to any difference between said speed of said grooved belt means and the peripheral speed of said transfer conveyor means.

2. An apparatus as defined in claim 1, comprising means to regulate the rotational speed of said transfer conveyor means to be constant at predetermined values.

3. An apparatus as defined in claim 1, wherein said feeder means comprises two spaced parallel smooth conveyor belts.

4. An apparatus as defined in claim 3, wherein said conveyor belts lap roller means displaceable together with said transfer conveyor means.

5. An apparatus as defined in claim 1, wherein said transfer conveyor means comprises a grooved wheel.

* * * * *